US008253070B1

(12) United States Patent
Barnes

(10) Patent No.: US 8,253,070 B1
(45) Date of Patent: Aug. 28, 2012

(54) HEATED LOCK DEVICES

(76) Inventor: Denise K. Barnes, Lake, MI (US)

( * ) Notice: Subject to any disclaimer, the term of this patent is extended or adjusted under 35 U.S.C. 154(b) by 198 days.

(21) Appl. No.: 12/716,997

(22) Filed: Mar. 3, 2010

(51) Int. Cl.
*H05B 3/00* (2006.01)

(52) U.S. Cl. ..... 219/201; 70/57.1

(58) Field of Classification Search ..... 219/201, 219/74, 136, 137.9, 133, 134; 70/38 R, 38 C, 70/38 A, 53, 57.1, 20–22, 39, 31–35, 25–26, 70/308, 432, 311–312, 320–322; 362/23, 362/253, 276, 234, 109, 100, 116
See application file for complete search history.

(56) References Cited

U.S. PATENT DOCUMENTS 2,774,855 A * 12/1956 Simmons ..... 70/492
3,192,359 A 6/1965 Swindall
3,662,149 A 5/1972 Lipinski
4,043,159 A * 8/1977 Malacheski et al. ..... 70/38 R
4,442,341 A 4/1984 Lesquereux et al.
4,927,993 A 5/1990 Simmons
D316,955 S 5/1991 Goida et al.
7,490,497 B2 2/2009 Adcock
2008/0078213 A1* 4/2008 Adcock ..... 70/57.1
2008/0173049 A1* 7/2008 Burmesch et al. ..... 70/25
* cited by examiner

*Primary Examiner* — Quang Van
*Assistant Examiner* — Phuong Nguyen

(57) ABSTRACT

A heated lock device featuring a standard padlock housing with a curved lock and a key sleeve; heating elements coiled around the first end of the curved lock, the second end of the curved lock, and the key sleeve; a power source housed in a battery compartment; a heat transformer operatively connected to the power source, the heat transformer comprises a button wherein when the button is pressed the heat transformer is activated to allow current to be transferred to the heating elements via wires; a spring-mediated mechanism of pressing the button of the heat transfer via the key sleeve; and at least one drain hole disposed in the housing for draining moisture from the curved lock or the key sleeve.

2 Claims, 6 Drawing Sheets

HEATED LOCK DEVICES

FIELD OF THE INVENTION

The present invention is directed to lock devices such as padlocks, key locks, and combination locks, more particularly to a lock devices with heating components to heat the internal components of the lock devices during cold conditions.

BACKGROUND OF THE INVENTION

During cold and freezing conditions, moisture that has accumulated around internal components of a lock has a tendency to become frozen, thereby preventing the lock from being opened. The present invention features heated lock devices comprising a means of heating the lock when needed. The heated lock devices of the present invention heat the internal components of the lock via heating coils that wrap around the lock mechanisms, providing even heat to the lock mechanisms. The heated lock devices of the present invention also allow condensation to drain from the inner cavity of the lock devices via drainage holes.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a heated lock device comprising a standard padlock housing with a standard curved lock, a first end of the curved lock is disposed in a first shaft in a top surface of the housing and a second end of the curved lock is slidably disposed in a second shaft in the top surface of the housing, and a key sleeve with a keyhole is positioned in between the first end and the second end of the curved lock, wherein the key sleeve is slidably disposed in the housing; a first heating element coiled around the first end of the curved lock, a second heating element coiled around the second end of the curved lock, and a third heating element coiled around the key sleeve; a power source housed in a battery compartment disposed in the housing; and a heat transformer operatively connected to the power source, the heat transformer comprises a button wherein when the button is pressed the heat transformer is activated to allow current to be transferred to the heating elements via wires.

The heated lock device further comprises a spring recess chamber disposed in the housing, wherein a stopper disposed on a second end of the key sleeve extends into the spring recess chamber and functions to compress a spring disposed in the spring recess chamber; a pressure spring bar disposed on the stopper and extending into the spring recess chamber, wherein the spring is coiled around the pressure spring bar, wherein the pressure spring bar is slidably in contact with the button of the heat transformer; wherein the pressure spring bar can move between an up position wherein the pressure spring bar presses the button of the heat transformer and a down position wherein the pressure spring bar does not contact the button of the heat transformer, wherein the pressure spring bar is biased in the up position caused by the spring, and wherein insertion of a key into the key sleeve pushes down on the key sleeve causing the pressure spring bar to move to the down position; and at least one drain hole disposed in the housing for draining moisture from the first shaft, the second shaft, or the key sleeve.

In some embodiments, the first heating element is disposed in the first shaft of the housing and the second heating element is disposed in the second shaft of the housing. In some embodiments, the battery is a button cell battery. In some embodiments, the device further comprises a battery-holding tray adapted to slide into the battery compartment. In some embodiments, a door is pivotally attached to the housing, the door can move between an open position and a closed position for respectively allowing and preventing access to the battery compartment. In some embodiments, the device comprises a first drain hole for the first shaft, a second drain hole for the second shaft, and a third drain hole for the key sleeve.

The present invention also features a heated lock device comprising a standard combination lock housing with a standard curved lock, a first end of the curved lock is disposed in a first shaft in a top surface of the housing and a second end of the curved lock is slidably disposed in a second shaft in the top surface of the housing, and a dial is disposed on a front surface of the housing; a first heating element coiled around the first end of the curved lock, a second heating element coiled around the second end of the curved lock, and a third heating element coiled around the dial; a power source housed in a battery compartment disposed in the housing; and a heat transformer operatively connected to the power source, the heat transformer comprises a button wherein when the button is pressed the heat transformer is activated to allow current to be transferred to the heating elements via wires.

The heated lock device further comprises an activation button slidably disposed in the dial, a second end of the activation button extends into a spring recess chamber in the inner cavity of the housing; a stopper disposed on the second end of the activation button, the stopper functions to compress a spring disposed in the spring recess chamber; a pressure spring bar disposed on the stopper and extending into the spring recess chamber, wherein the spring is coiled around the pressure spring bar, wherein the pressure spring bar is slidably in contact with the button of the heat transformer, the pressure spring bar can move between an up position wherein the pressure spring bar presses the button of the heat transformer and a down position wherein the pressure spring bar does not contact the button of the heat transformer, wherein the pressure spring bar is biased in the up position caused by the spring, and wherein pushing on the activation button moves the pressure spring bar to the down position; and at least one drain hole disposed in the housing for draining moisture from the dial, the first end of the curved lock, or the second end of the curved lock.

In some embodiments, the battery is a button cell battery. In some embodiments, the device further comprises a battery-holding tray adapted to slide into the battery compartment. In some embodiments, a door is pivotally attached to the housing, the door can move between an open position and a closed position for respectively allowing and preventing access to the battery compartment. In some embodiments, the device comprises a first drain hole for the dial, a second drain hole for the first end of the curved lock, and a third drain hole for second end of the curved lock.

DESCRIPTION OF PREFERRED EMBODIMENTS

Figure 5:
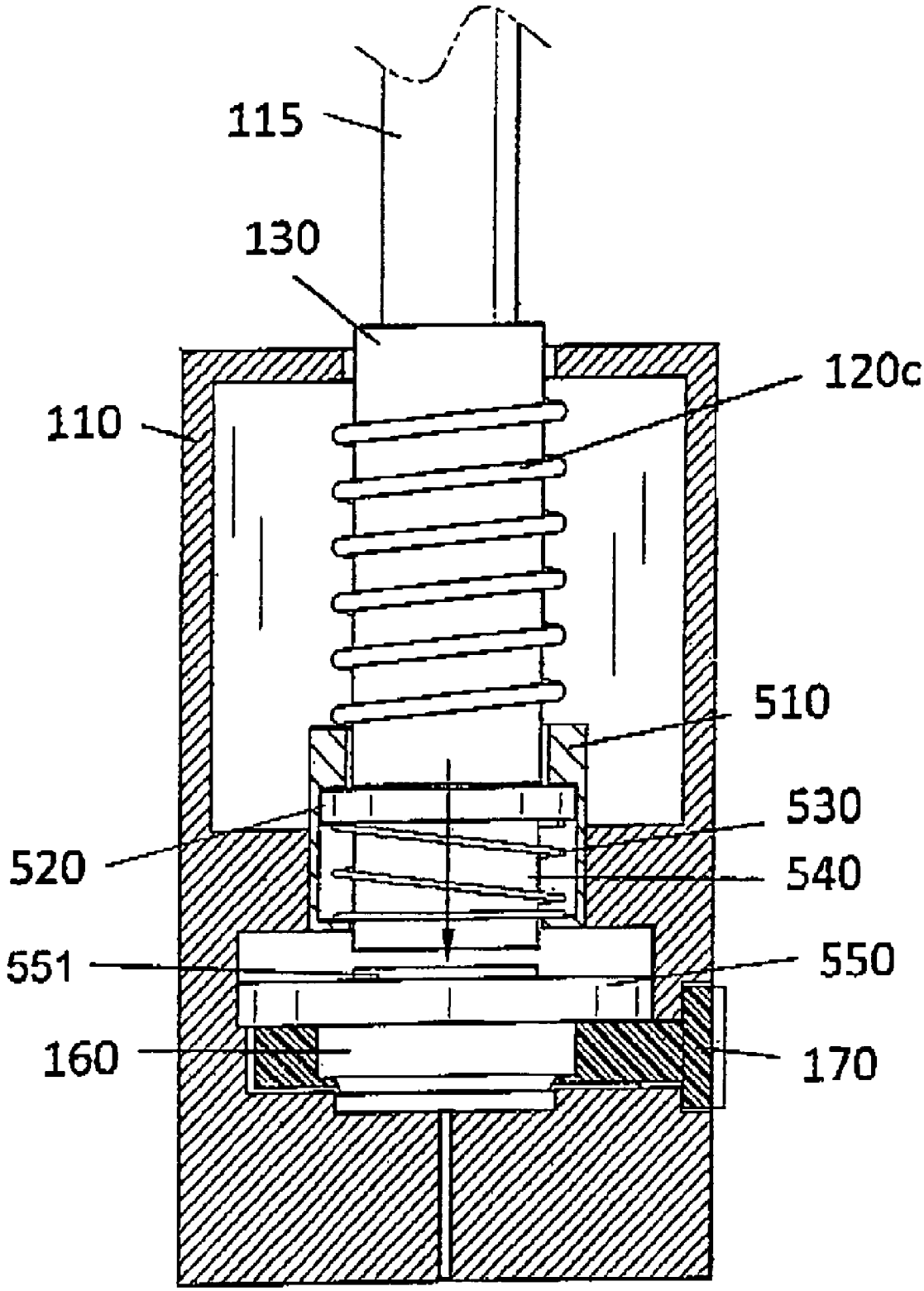
FIG. 5 is a side cross sectional view of the heated lock device of FIG. 3.
Figure 6:
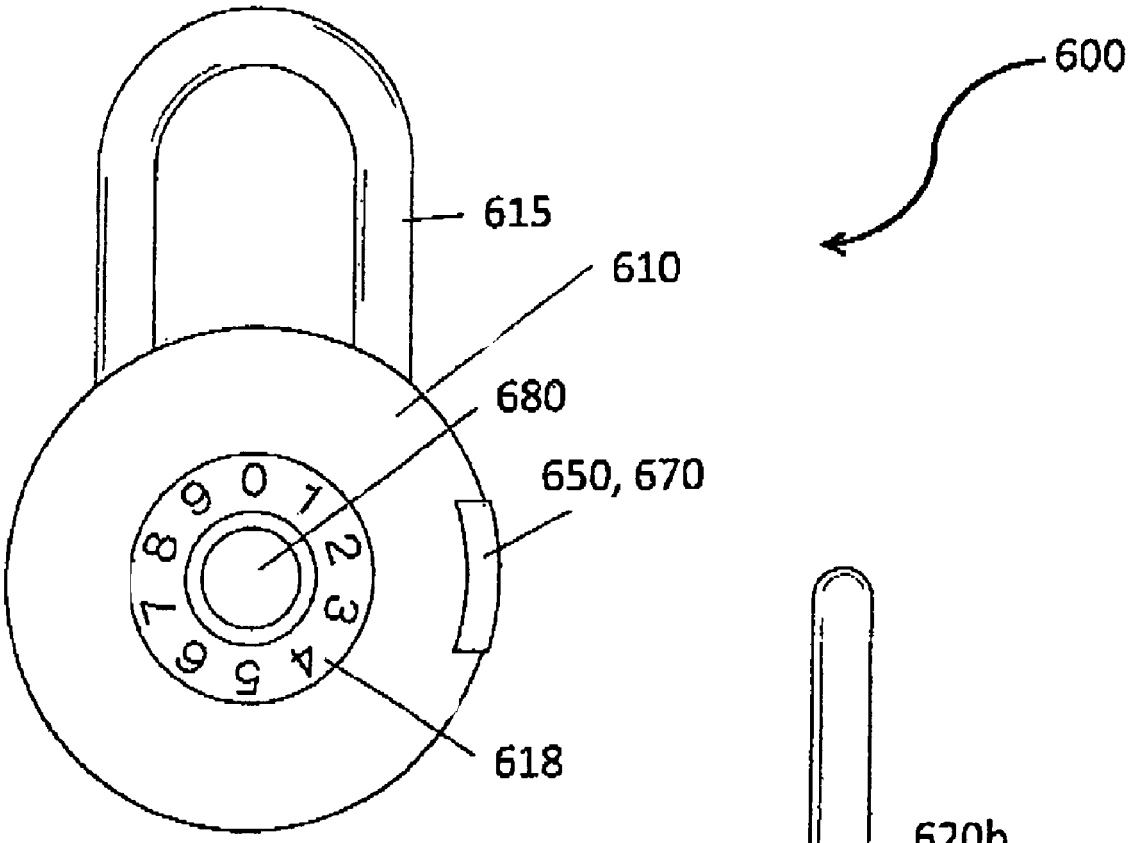
FIG. 6 is a front view of an alternative embodiment of the heated lock device of the present invention. The heated lock device is not limited to padlocks with keys but can include combination locks the like one shown in FIG. 6.
Figure 7:
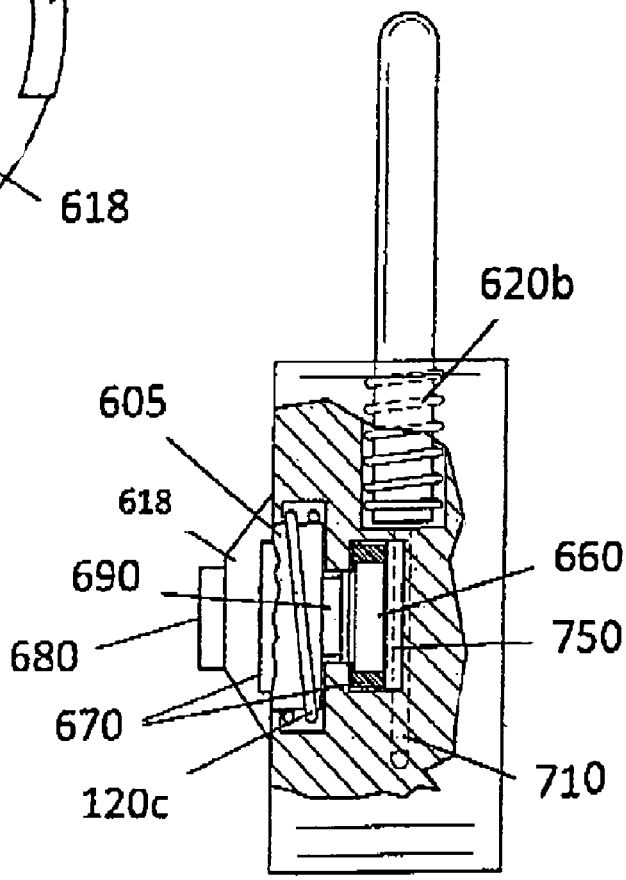
FIG. 7 is a side and internal view of the heated lock device of FIG. 6.
Figure 8:
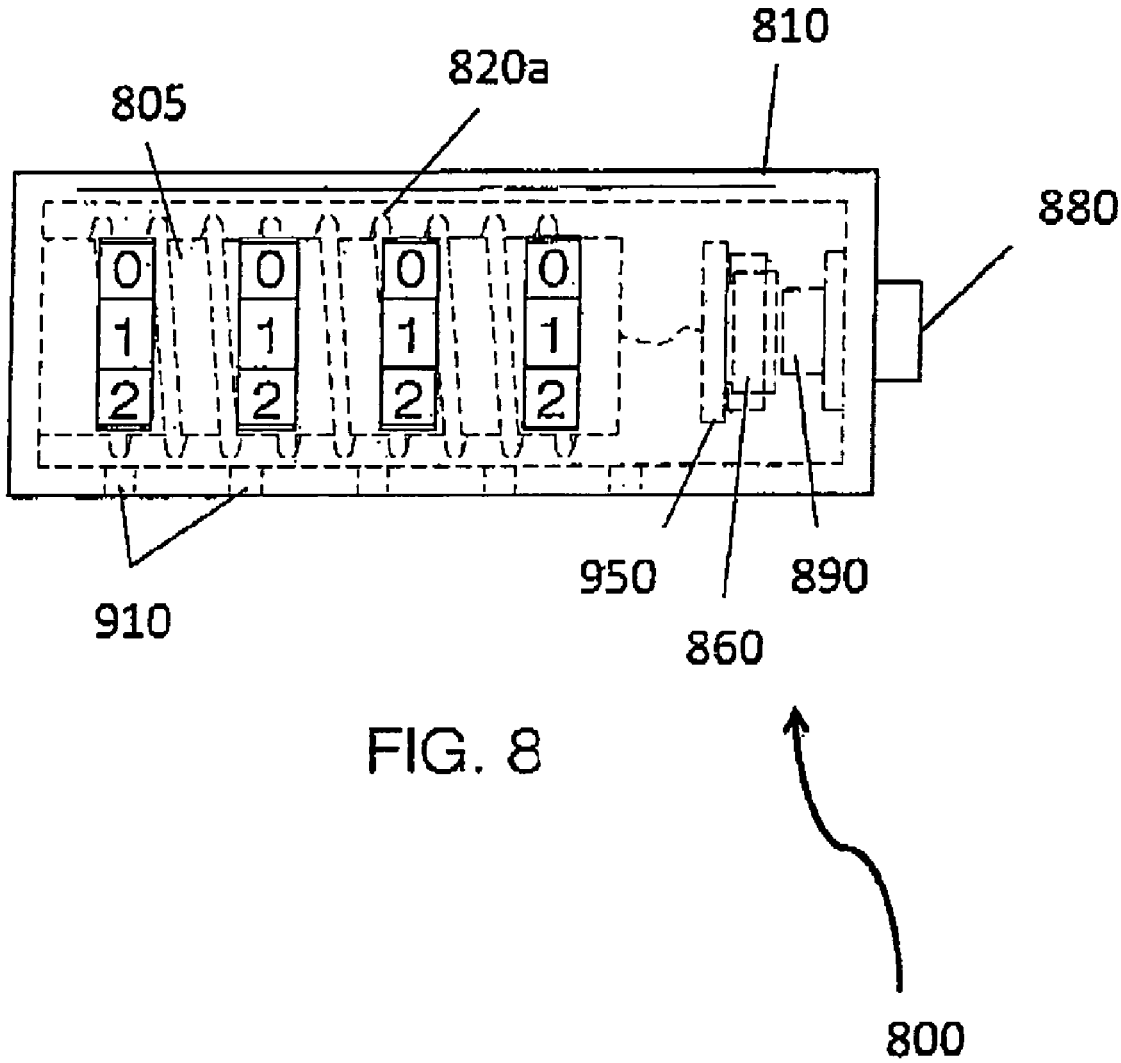
FIG. 8 is a front view of an alternative embodiment of the heated lock device of the present invention, wherein the heated lock device is a combination lock.

Referring now to FIGS. 1-8, the present invention features a heated lock device 100. The heated lock device 100 of the present invention can heat the internal components of the heated lock device 100 (e.g., via heating elements 120). The heated lock device 100 also allows condensation to drain from the inner cavity of the lock device 100 via drainage holes. The heated lock device 100 of the present invention may be particularly useful during cold (freezing) conditions. Without wishing to limit the present invention to any theory or mechanism, it is believed that the heated lock device 100 of the present invention is advantageous because the heating elements are evenly coiled or wrapped around the components of the device so as to evenly provide heat (without overheating). The drainage holes can drain moisture away as well as help aerate the inner cavity of the heated lock device 100 (e.g., the housing 110). The heated lock device 100 of the present invention also features a removable battery, which allows replacement of the battery thereby helping increase the longevity of the heated lock device 100. The heated lock device 100 of the present invention is not limited to padlocks with keys (as shown in FIGS. 1-5). The device 100 can include combination locks as shown in FIG. 6, FIG. 7, and FIG. 8.

Padlocks

Referring now to FIGS. 1-5, the lock device 100 comprises a housing 110 with a curved lock 115. In some embodiments, the housing 110 and curved lock 115 are generally similar to housings and curved locks 115 of standard padlocks, which are well known to one of ordinary skill in the art. In some embodiments, the housing 110 is larger than standard padlock housings.

Figure 1:
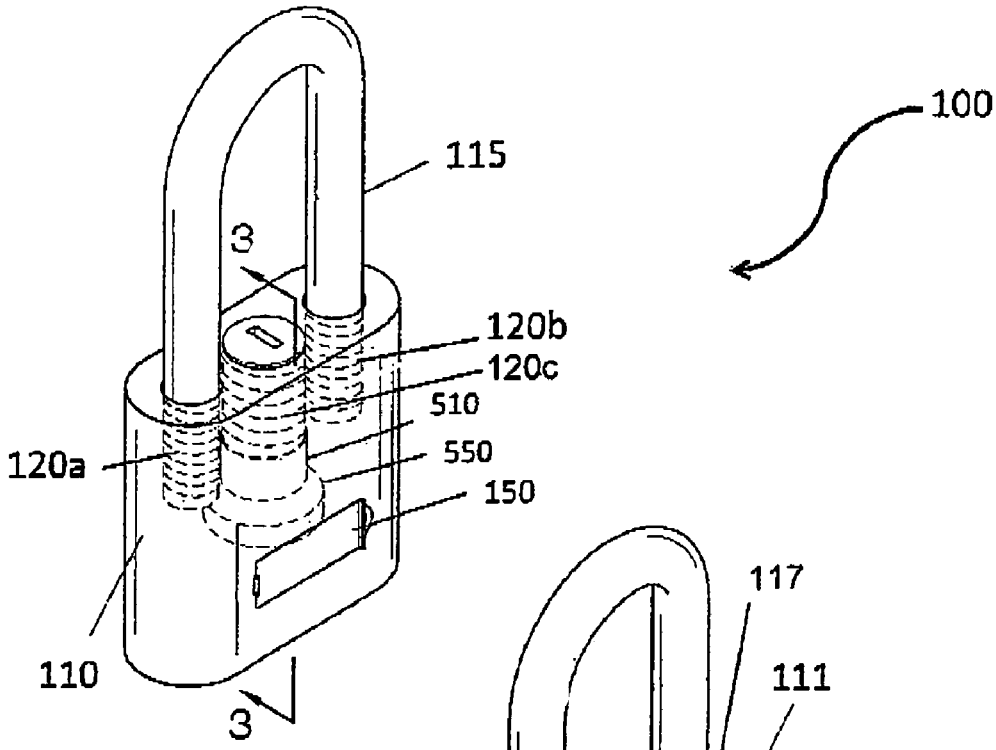
FIG. 1 is a first perspective view of the heated lock device of the present invention. The heating elements are shown in phantom.
Figure 5A:
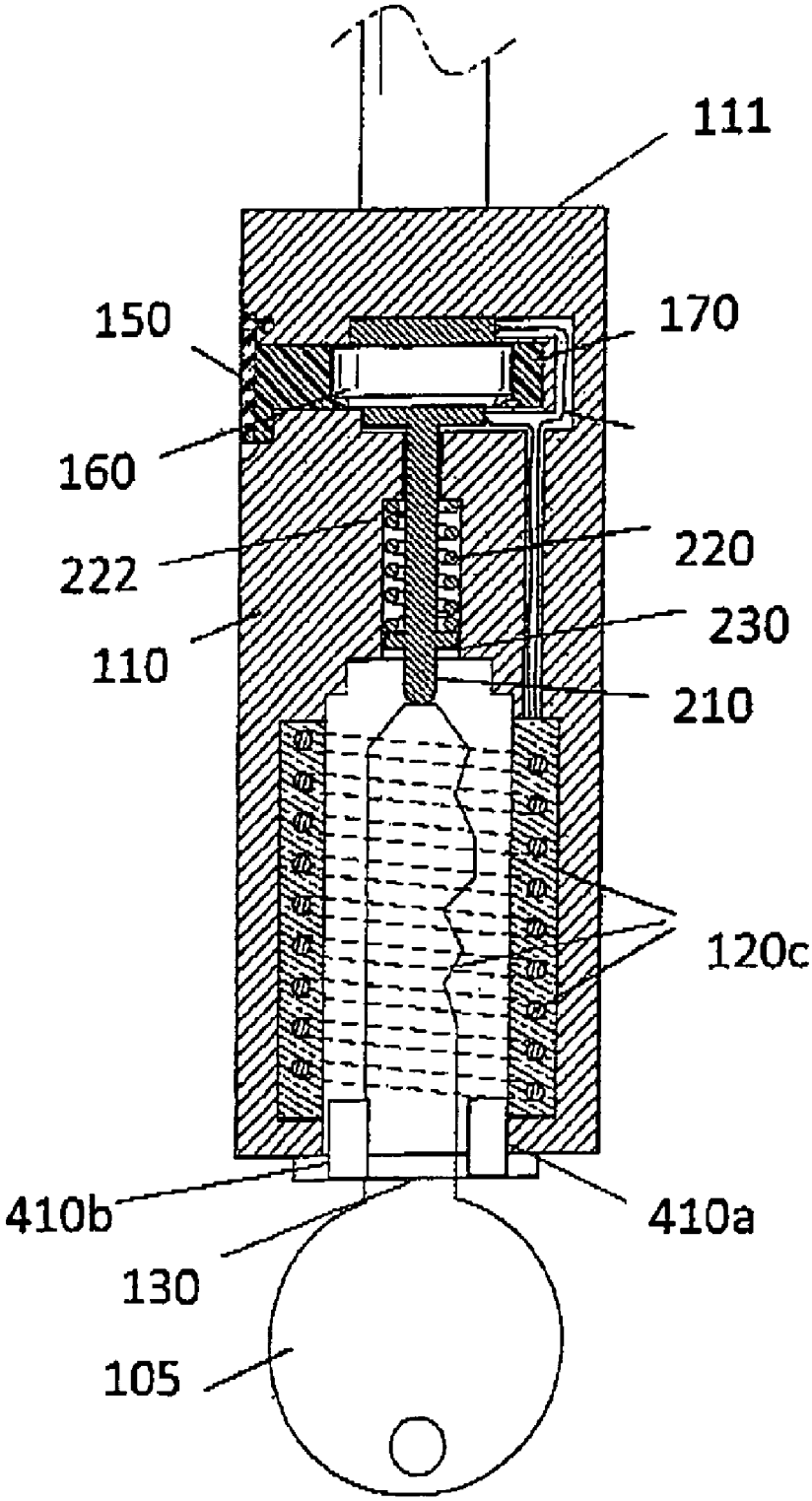
FIG. 5A is a front cross sectional view of an alternative embodiment of the heated lock device of the present invention, wherein a key is inserted into the key sleeve.

As shown in FIG. 1, the first end (first cylinder) of the curved lock 115 is disposed in the inner cavity of the housing 110 and the first end of the curved lock 115 extends out of a first shaft 116 in the top surface 111 of the housing 110. The second end (second cylinder) of the curved lock 115 can move in and out of the inner cavity of the housing 110 via a second shaft 117 disposed in the top surface 110 of the housing 110. Like standard padlocks, a hasp is disposed on the second end of the curved lock 115. A latch in the inner cavity of the housing 110 engages the hasp to lock the lock device 100 and hold the second end of the curved lock 115 in the inner cavity of the housing 110. Hasps and corresponding latches are well known to one of ordinary skill in the art. Other lock standard components (e.g., key sleeve 130) are disposed in the inner cavity of the housing 110. As shown in FIG. 1, the key sleeve 130 is positioned in between the first end and second end of the curved lock 115 and the keyhole is disposed in the top surface 111 of the housing 110. As shown in FIG. 5A, the keyhole is disposed in the bottom surface 112 of the housing 110.

The first shaft in the housing 110 comprises a first heating element 120*a*. The first heating element 120*a* is coiled around the portion of the first end of the curved lock 115 that is disposed in the inner cavity of the housing 110. The second shaft in the housing 110 comprises a second heating element 120*b*. The second heating element 120*b* coils around the second end of the curved lock (when the second end of the curved lock is in the second shaft). The key sleeve 130 comprises a third heating element 120*c*, which coils around the key sleeve 130. The heating elements 120 are evenly wrapped around the shafts or key sleeve 130 to heat evenly.

Figure 2:
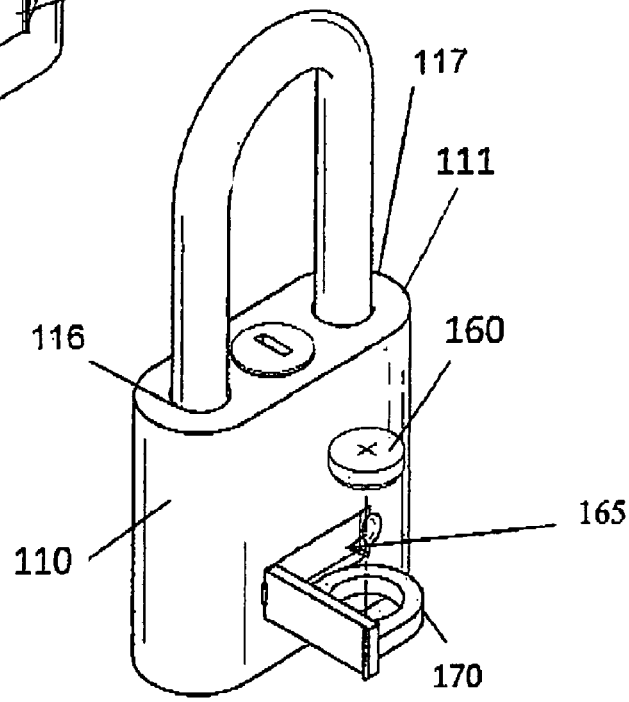
FIG. 2 is a second perspective view of the heated lock device of FIG. 1 wherein the door is opened and the battery tray is removed.
Figure 3:
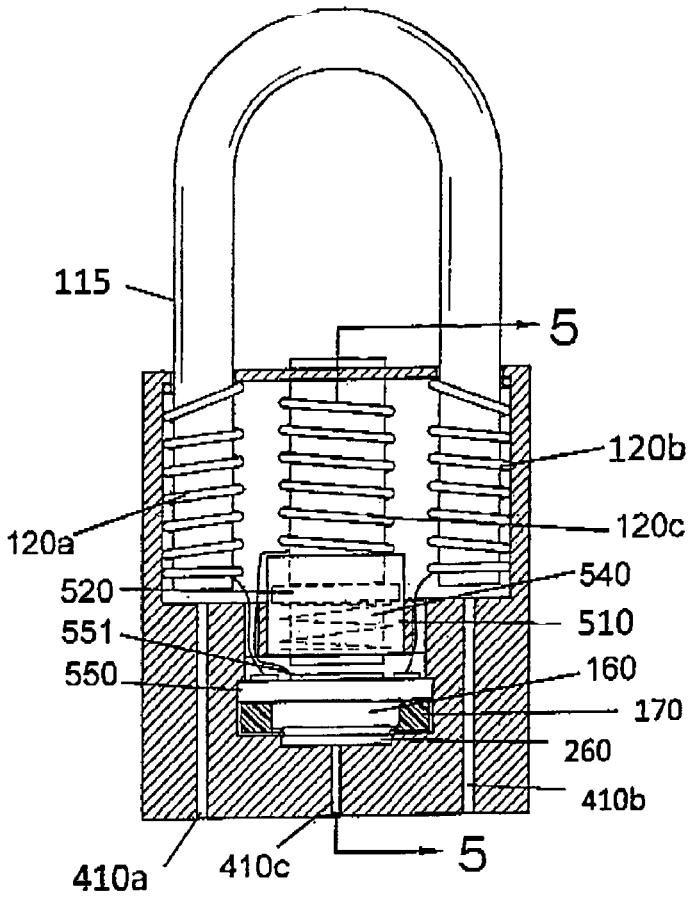
FIG. 3 is a front cross sectional view of the heated lock device of FIG. 1.
Figure 4:
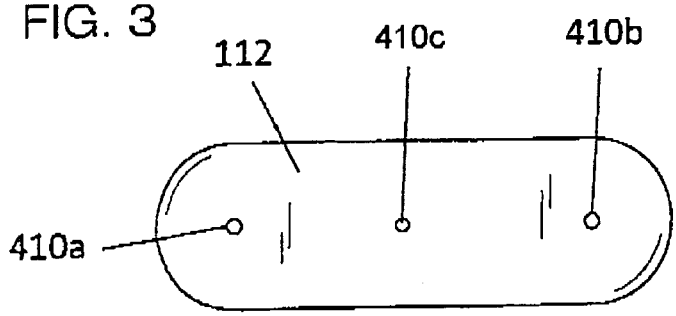
FIG. 4 is a bottom view of the heated lock device of FIG. 1.

The heated lock device 100 of the present invention further comprises a power source, for example a battery 160. In some embodiments, the battery 160 is a lithium battery (e.g., button cell battery) or a rechargeable battery. The power source (e.g., battery 160) is housed in a battery compartment (165) disposed in the housing 110. As shown in FIG. 2, a battery-holding tray 170 is adapted to fit into (e.g., slide into) the battery compartment (165). In some embodiments, as shown in FIG. 1 and FIG. 2, the battery compartment (165) is positioned near the bottom surface 112 of the housing 110. FIG. 3 shows the battery compartment (165) with the power source (e.g., battery 160) is positioned below the key sleeve 130. The battery compartment (165) and power source (e.g., battery 160) is not limited to this position. For example, FIG. 5A shows the battery 160 positioned near the top surface 111 of the housing 110. In some embodiments, a door 150 is pivotally attached to the housing 110 and can move between an open position and a closed position for respectively allowing and preventing access to the battery compartment (165).

The activation of the heating elements 120 is regulated. In some embodiments, the activation means is a spring-loaded mechanism. As shown in FIG. 5, the key sleeve 130 is slidably disposed in the inner cavity of the housing 110. The first end of the key sleeve 130 is positioned at the top end of the housing 110. The second end of the key sleeve 130 extends in the inner cavity of the housing 110 into a spring recess chamber 510. Disposed on the second end of the key sleeve 130 is a stopper 520 which functions to compress a spring 530 disposed in the spring recess chamber 510.

Disposed on the stopper 520 is a pressure spring bar 540. The spring 530 is coiled around the pressure spring bar 540. The pressure spring bar 540 is slidably in contact with a heat transformer 550 disposed above the power source (e.g., battery 160). As shown in FIG. 5, the heat transformer 550 is disposed above the battery 160, and a base contact plate 260 is disposed below the battery 160. The heat transformer 550 is operatively connected to the power source (e.g., battery 160). The heat transformer 550 comprises a button 551. When the button 551 is pressed, the heat transformer 550 is activated, allowing current or heat to be transferred to the heating elements 120 (e.g., via wires). The pressure spring bar 540 can move between an up position wherein the pressure spring bar 540 contacts the heat transformer 550 by depressing the button 551 (activating the heat transformer 550) and a down position wherein the pressure spring bar 540 does not contact the heat transformer 550 (the button 551). The pressure spring bar 540 is biased in the up position caused by the spring 530. FIG. 3 shows the pressure spring bar 540 in the up position (not in contact with the heat transformer 550), and FIG. 5 shows the pressure spring bar 540 moving down to the down position (to be in contact with the heat transformer 550). As shown in FIG. 3, the first heating element 120*a*, second heating element 120*b*, and third heating element 120*c* are each operatively connected to the heat transformer via a wire.

As shown in FIG. 5A, a contact pin 210 is disposed at the end of the keyway 190. The contact pin 210 has a first end and a second end, the first end being disposed at the end of the key sleeve 130 and the second end extending toward the power source (e.g., battery 160). The contact pin 210 is movable between an up position wherein the second end of the contact pin 210 is not in contact with the power source (e.g., battery 160) and a down position wherein the second end of the contact pin 210 is in contact with the power source (e.g., battery 160). FIG. 5A shows the contact pin 210 in the down position contacting the battery 160. The contact pin 210 is biased in the inactive position caused by a spring 220. The spring 220 is disposed in a spring compartment 222 and is coiled around the contact pin 210. A stopper 230 is disposed on the contact pin 210 near the first end of the contact pin 210. The stopper 230 compresses the spring 220 when the contact pin 210 is moved to the down position. The contact pin 210 can be moved to the down position by inserting a key 105 into the key sleeve 130. When the key 105 is removed from the key sleeve 130, the spring 220 pushes upwardly on the stopper 230 to move the contact pin 210 back to the up position.

When the contact pin 210 contacts the power source (e.g., battery 160), current can flow from the battery 160 to the heating elements 120. When the contact pin 210 does not contact the power source (e.g., battery 160), the circuit is broken and no power is delivered to the heating elements 120. As shown in FIG. 5A, the heating element 120*c* is operatively connected to a base contact plate (which contacts a first terminal of the battery 160 via a first wire 125*a*. The heating element 120*c* is operatively connected to the contact pin 210 via a second wire 125*b*, the contact pin 210 being for contacting the second terminal of the battery 160.

Disposed in the housing are a first drain hole 410*a*, a second drain hole 410*b*, and a third drain hole 410*c*. As shown in FIG. 3, the first drain hole 410*a* extends from the inner cavity of the housing 110 near the first end of the curved lock 115 down to the bottom surface 112 of the housing 110. The second drain hole 410*b* extends from the inner cavity of the housing 110 near the second end of the curved lock 115 down to the bottom surface 112 of the housing 110. The third drain hole 410*c* extends from the key sleeve 130 of the housing 110 near the middle of the curved lock 115 down to the bottom surface 112 of the housing. The drain holes 410 allow condensation to drain from the inner cavity of the housing 110. For example, if the lock device 100 becomes frozen and the heating elements 120 are activated, the ice will condense in the inner cavity of the housing 110. The drain holes 410 allow this condensation to be drained. Also, the drain holes 410 help aerate the inner cavity of the housing 110.

Combination Locks

The present invention is not limited to padlock locking devices that use keys (e.g., as shown in FIGS. 1-5). FIG. 6, FIG. 7, and FIG. 8 show alternative embodiments of the heated lock device 100 of the present invention, wherein the locking devices are combination locks. Combination locks and mechanisms of locking and unlocking such locks are well known to one of ordinary skill in the art.

Referring now to FIG. 6 and FIG. 7, the lock device 600 comprises a housing 610 with a curved lock 615. In some embodiments, the housing 610 and curved lock 615 are generally similar to housings and curved locks of standard combination locks, which are well known to one of ordinary skill in the art. In some embodiments, the housing 610 is larger than standard combination lock housings.

The first end (first cylinder) of the curved lock 615 is disposed in the inner cavity of the housing 610 and the first end of the curved lock 615 extends out of a first shaft in the top surface of the housing 610. The second end (second cylinder) of the curved lock 615 can move in and out of the inner cavity of the housing 610 via a second shaft disposed in the top surface of the housing 610. Like standard combination locks, a hasp is disposed on the second end of the curved lock 615. A latch in the inner cavity of the housing 610 engages the hasp to lock the lock device 100 and hold the second end of the curved lock 615 in the inner cavity of the housing 610. Hasps and corresponding latches are well known to one of ordinary skill in the art. Other lock standard components (e.g., cams 605) are disposed in the inner cavity of the housing 610. A dial 618 is disposed on the front surface of the housing 610. The dial 618 regulates the movement of the cams 605.

The first shaft in the housing 610 comprises a first heating element. The first heating element is coiled around the portion of the first end of the curved lock 615 that is disposed in the inner cavity of the housing 110. The second shaft in the housing 110 comprises a second heating element 620*b*. The second heating element 620*b* coils around the second end of the curved lock 615 (when the second end of the curved lock is in the second shaft). A third heating element 120*c* is coiled around the dial 618. The heating elements 620 are evenly wrapped around the shafts or dial 618 to heat evenly.

The heated lock device 600 of the present invention further comprises a power source, for example a battery 660. In some embodiments, the battery 660 is a lithium battery (e.g., button cell battery) or a rechargeable battery. The power source (e.g., battery 660) is housed in a battery compartment disposed in the housing 610. In some embodiments, the battery 660 fits into a battery-holding tray 670, which is adapted to fit into (e.g., slide into) the battery compartment. In some embodiments, a door 650 is pivotally attached to the housing 610 and can move between an open position and a closed position for respectively allowing and preventing access to the battery compartment.

In some embodiments, an activation button 680 is slidably disposed in the dial 618 and extends into the inner cavity of the housing 610. The second end of the activation button 680 extends into a spring recess chamber 690 in the inner cavity of the housing 610. Disposed on the second end of the activation button 680 is a stopper which functions to compress a spring disposed in the spring recess chamber 690.

Disposed on the stopper is a pressure spring bar. The spring is coiled around the pressure spring bar. In some embodiments, the pressure spring bar is slidably in contact with a heat transformer 750, which disposed adjacent to the power source (e.g., battery 660). In some embodiments, the pressure spring bar is slidably in contact with the battery 660, which is disposed adjacent to the heat transformer 750. The heat transformer is operatively connected to the heating elements 620 via one or more wires.

In some embodiments, the heat transformer 750 is operatively connected to the power source (e.g., battery 660). The heat transformer 750 comprises a button. When the button is pressed via the pressure spring bar, the heat transformer 750 is activated, allowing current or heat to be transferred to the heating elements 620 (e.g., via wires). The pressure spring bar can move between an up position wherein the pressure spring bar contacts the heat transformer 750 by depressing the button (activating the heat transformer 750) and a down position wherein the pressure spring bar does not contact the heat transformer 750 (the button). The pressure spring bar is biased in the up position caused by the spring.

In some embodiments, the pressure spring bar is slidably in contact with the battery 660, which is disposed adjacent to the heat transformer 750. The pressure spring bar can move between an up position wherein the pressure spring bar contacts the battery 660 and a down position wherein the pressure spring bar does not contact the battery 160. The pressure spring bar is biased in the up position caused by the spring. When the pressure spring bar is moved to the down position (contacting the battery 160), the heat transformer 750 is activated (e.g., via a button), allowing current or heat to be transferred to the heating elements 620.

As shown in FIG. 7, one or more drain holes 710 are disposed in the housing 610. In some embodiments, a drain hole 710 extends from the inner cavity of the housing 610 and/or the battery compartment (or other location) down to the bottom surface of the housing 610. The drain holes 710 are not limited to this position. The drain hole 710 allows condensation to drain from the inner cavity of the housing 610. For example, if the lock device 600 becomes frozen and the heating elements 620 are activated, the ice will condense in the inner cavity of the housing 610. The drain holes 710 allow this condensation to be drained. Also, the drain holes 710 help aerate the inner cavity of the housing 610.

Referring now to FIG. 8, the lock device 800 comprises a housing 810 having a first end and a second end. The housing 810 may be generally similar to housings of standard combination locks (dial locks), which are well known to one of ordinary skill in the art. In some embodiments, the housing 610 is larger than standard combination (dial) lock housings. A plurality of standard dials 815 is disposed on the housing 810. The dials 815 are connected via a tumbler 805 disposed in the inner cavity of the housing 810. Dials and tumblers for combination locks are well known to one of ordinary skill in the art.

A first heating element 820*a* is evenly wrapped around the tumbler 805 in the inner cavity of the housing 810. The heated lock device 800 of the present invention further comprises a power source, for example a battery 860. In some embodiments, the battery 860 is a lithium battery (e.g., button cell battery) or a rechargeable battery. The power source (e.g., battery 860) is housed in a battery compartment disposed in the housing 810. In some embodiments, the battery 860 fits into a battery-holding tray, which is adapted to fit into (e.g., slide into) the battery compartment. In some embodiments, a door is pivotally attached to the housing 810 and can move between an open position and a closed position for respectively allowing and preventing access to the battery compartment.

In some embodiments, an activation button 880 is slidably disposed in the housing 810 (e.g., on the first end or on the second end) and extends into the inner cavity of the housing 810. The second end of the activation button 880 extends into a spring recess chamber in the inner cavity of the housing 810. Disposed on the second end of the activation button 880 is a stopper which functions to compress a spring disposed in the spring recess chamber.

Disposed on the stopper is a pressure spring bar 890. The spring is coiled around the pressure spring bar 890. In some embodiments, the pressure spring bar 890 is slidably in contact with a heat transformer 950, which disposed adjacent to the power source (e.g., battery 860). In some embodiments, the pressure spring bar is slidably in contact with the battery 860, which is disposed adjacent to the heat transformer 950. The heat transformer 950 is operatively connected to the heating element 820 via one or more wires.

In some embodiments, the heat transformer 950 is operatively connected to the power source (e.g., battery 860). The heat transformer 950 may comprise a button. When the button is pressed via the pressure spring bar 890, the heat transformer 950 is activated, allowing current or heat to be transferred to the heating elements 620 (e.g., via wires). The pressure spring bar 890 can move between an up position wherein the pressure spring bar 890 contacts the heat transformer 950 by depressing the button (activating the heat transformer 950) and a down position wherein the pressure spring bar 890 does not contact the heat transformer 950 (the button). The pressure spring bar 890 is biased in the up position caused by the spring.

As shown in FIG. 8, in some embodiments, the pressure spring bar 890 is slidably in contact with the battery 660, which is disposed adjacent to the heat transformer 950. The pressure spring bar 890 can move between an up position wherein the pressure spring bar 890 contacts the battery 860 and a down position wherein the pressure spring bar 890 does not contact the battery 860. The pressure spring bar 890 is biased in the up position caused by the spring. When the pressure spring bar 890 is moved to the down position (contacting the battery 860), the heat transformer 950 is activated, allowing current or heat to be transferred to the heating elements 620.

As shown in FIG. 8, one or more drain holes 910 are disposed in the housing 810. In some embodiments, a drain hole 710 extends from the inner cavity of the housing 610 down to the first end of the housing 810, the second end of the housing 810 and/or a side edge of the housing 810. The drain hole 910 allows condensation to drain from the inner cavity of the housing 810. For example, if the lock device 800 becomes frozen and the heating elements 820 are activated, the ice will condense in the inner cavity of the housing 810. The drain holes 910 allow this condensation to be drained. Also, the drain holes 910 help aerate the inner cavity of the housing 810.

The following the disclosures of the following U.S. Patents are incorporated in their entirety by reference herein: U.S. Pat. No. 7,490,497; U.S. Pat. No. 4,927,993; U.S. Pat. No. 4,442,341; U.S. Pat. No. 3,662,149.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A heated lock device (100) comprising:

(a) a standard lock housing (110) with a standard curved lock (115), a first end of the curved lock (115) is disposed in a first shaft in a top surface (111) of the housing (110) and a second end of the curved lock (115) is slidably disposed in a second shaft in the top surface (111) of the housing (110), and a key sleeve (130) with a keyhole is positioned in between the first end and the second end of the curved lock (115) on the top surface (111), wherein the key sleeve (130) is slidably disposed in the housing (110);

(b) a first heating element (120*a*) coiled around the first end of the curved lock (115), a second heating element (120*b*) coiled around the second end of the curved lock (115), and a third heating element (120*c*) coiled around the key sleeve (130);

(c) a power source, wherein the power source is a button cell battery (160), is housed in a battery compartment disposed in the housing (110), wherein a door (150) is pivotally attached to the housing (110), the door (150) can move between an open position and a closed position for respectively allowing and preventing access to the battery compartment (165), a battery-holding tray (170) adapted to slide into the battery compartment (165) and the battery-holding tray (170) is attached behind the door (150);

(d) a heat transformer (550) operatively connected to the power source (160), the heat transformer (550) comprises a button (551) wherein when the button (551) is pressed the heat transformer (550) is activated to allow current to be transferred to the first heating element[s] (120*a*), the second heating element (120*b*), and the third heating element (120*c*) via wires;

(e) a spring recess chamber (510) disposed in the housing (110), wherein a stopper (520) disposed on a second end of the key sleeve (130) extends into the spring recess chamber (510) and functions to compress a spring (530) disposed in the spring recess chamber (510);

(f) a pressure spring bar (540) disposed on the stopper (520) and extending into the spring recess chamber (510), wherein the spring (530) is coiled around the pressure spring bar (540), wherein the pressure spring bar (540) is slidably in contact with the button (551) of the heat transformer (550); wherein the pressure spring bar (540) can move between a down position wherein the pressure spring bar (540) presses the button (551) or the heat transformer (550) and an up position wherein the pressure spring bar (540) does not contact the button (551) of the heat transformer (550), wherein the pressure spring bar (540) is biased in the up position caused by the spring (530), and wherein insertion of a key into the key sleeve (130) pushes down on the key sleeve (130) causing the pressure spring bar (540) to move to the down position; and (g) a first drain hole (410*a*) for draining moisture from the first shaft, a second drain hole (410*b*) for draining moisture from the second shaft, and a third drain hole (410*c*) for draining moisture from the key sleeve (130) disposed in the housing (110).

2. The heated lock device of claim 1, wherein the first heating element (120*a*) is disposed in the first shaft of the housing (110) and the second heating element (120*b*) is disposed in the second shaft of the housing (110).

* * * * *